US007314391B1

(12) United States Patent
Yoshida

(10) Patent No.: US 7,314,391 B1
(45) Date of Patent: Jan. 1, 2008

(54) PLUG REMOVABLE FROM AND INSERTABLE INTO CIGAR LIGHTER SOCKET, AND PLUG EQUIPPED CORD

(75) Inventor: Masahiro Yoshida, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/716,127

(22) Filed: Mar. 8, 2007

(30) Foreign Application Priority Data

Jun. 20, 2006 (JP) ..... 2006-170280

(51) Int. Cl.
*H01R 24/04* (2006.01)

(52) U.S. Cl. ..... 439/668

(58) Field of Classification Search ..... 439/668, 439/736, 595, 578, 620, 669, 675, 701; 800/17 R, 800/1 R, 43.05
See application file for complete search history.

(56) References Cited

U.S. PATENT DOCUMENTS 5,842,560 A * 12/1998 Kuki et al. ..... 200/43.05
5,924,895 A 7/1999 Moji
6,580,040 B2 * 6/2003 Konda ..... 200/17 R
6,786,778 B2 * 9/2004 Lai ..... 439/701
6,902,436 B2 * 6/2005 Liao ..... 439/668
7,226,320 B2 * 6/2007 Abe et al. ..... 439/668

FOREIGN PATENT DOCUMENTS

| | | |
|---|---|---|
| JP | 10-199629 | 7/1998 |
| JP | 10-326648 | 12/1998 |
| JP | 2000-030814 | 1/2000 |

* cited by examiner

*Primary Examiner*—J. F. Duverne
(74) *Attorney, Agent, or Firm*—Blakely Sokoloff Taylor & Zafman, LLC

(57) ABSTRACT

According to one embodiment, a plug equipped cord (or, a plug) includes a compression spring between a fixed base, which is connected to a lead wire, and a contact terminal of a fuse. In addition, a RITZ wire is connected between a portion, in which the fixed base and the lead wire are soldered together, and the contact terminal.

20 Claims, 2 Drawing Sheets

PLUG REMOVABLE FROM AND INSERTABLE INTO CIGAR LIGHTER SOCKET, AND PLUG EQUIPPED CORD

CROSS-REFERENCE TO RELATED APPLICATIONS

This application is based upon and claims the benefit of priority from Japanese Patent Application No. 2006-170280, filed Jun. 20, 2006, the entire contents of which are incorporated herein by reference.

BACKGROUND

1. Field

One embodiment of the invention relates to, for example, a plug removable from and insertable into a cigar lighter socket of a motor vehicle, and a plug equipped cord.

2. Description of the Related Art

Conventionally, cigar lighter plugs of the type improved in removability from and insertability into a socket are known as a plug removable from and insertable into a cigar lighter socket of a motor vehicle. It is disclosed by, for example, Jpn. Pat. Appln. KOKAI Publication Nos. 10-326648, 10-199629, and 2000-30814. The plugs disclosed in the three patent publications each have a construction incorporating a technique that enables removal from and insertion into sockets having inside diameters different from one another.

In recent years, electrical appliances, such as TV receiver sets and refrigerators, for being used with power supplied through a cigar lighter plug of a motor vehicle are pervasive, and hence there is a tendency towards increase of power consumption. As such, especially in an environment, such as in the summer season, in which the temperature rises in the vehicle cabin interior, the plug inserted into the cigar lighter socket is heated to an abnormally high temperature, and a part of a housing is melted thereby in a worst case.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, a plug removable from and insertable into a cigar lighter socket includes a plug body; a first contact provided to a lead end of the plug body; a second contact extended externally from a peripheral surface of the plug body and coupled to a second lead wire; a slender fuse provided in the plug body and including one of contact terminals that is brought into contact with the first contact; a fixed electrode fixedly provided in the plug body and coupled to a first lead wire; a spring provided in a compressed state between the fixed electrode and the other one of the contact terminals of the fuse; a conductive member that is deformable and electrically short-circuits between the other one of the contact terminals of the fuse and the fixed electrode.

The embodiments of the invention will be described in detail herebelow with reference to the drawings.

Figure 1:
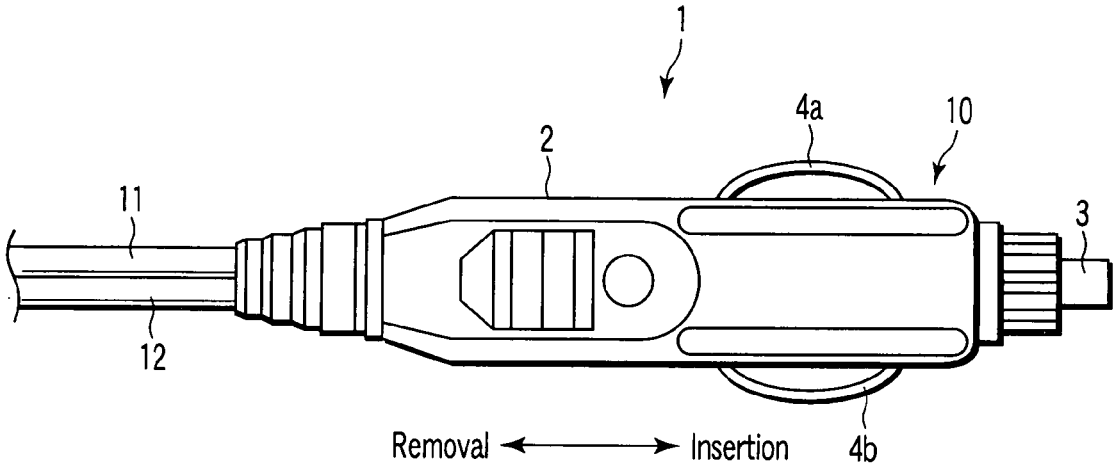
FIG. 1 is an exterior view showing an overall configuration of a plug equipped cord according to one embodiment of the invention.
Figure 2:
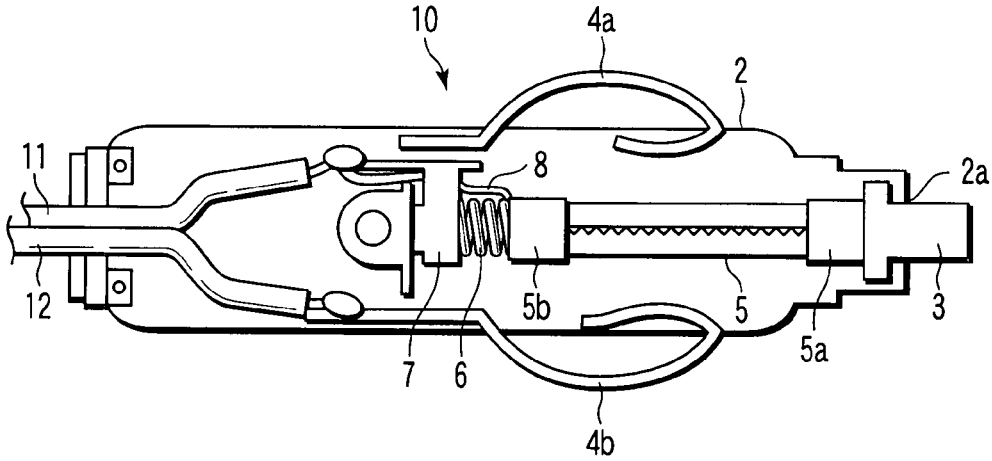
FIG. 2 is a schematic view showing an interior construction of a plug of the plug equipped cord shown in FIG. 1.

FIG. 1 is an exterior view showing a major-portion of a plug equipped cord 1 according to a first embodiment of the invention. FIG. 2 is a partially enlarged schematic view showing an interior construction of a plug 10. The plug equipped cord 1 (or, the plug 10) is removable from or insertable into a cigar lighter socket (not shown) of a motor vehicle. The plug equipped cord 1 is used to supply power from the cigar lighter socket to electrical appliances, such as a TV receiver set and a refrigerator.

As shown in FIG. 1, the plug equipped cord 1 (or, the plug 10) includes a plug body 2 having a substantially cylindrical shape and formed of an insulation material, such as plastic. A contact pin 3 (corresponding to the first contact) having the electro-conductivity is retractably provided on the side of the lead end along removal/insertion direction (arrow direction) with respect to the cigar lighter socket of the plug body 2. As shown in FIG. 2, the contact pin 3 is inserted from the inner side to be slidable with respect to an opening 2*a* provided to the lead end of the plug body 2, and is prevented by a fall-out prevention structure (not shown) from falling out. Two lead wires 11 and 12 are connected to a rear end side of the plug body 2.

Two contact springs 4*a* and 4*b* (second contacts) each formed of a metal plate outwardly arcuate are provided on the peripheral surface of the plug body 2. The two contact springs 4*a* and 4*b* are disposed substantially symmetric with respect to a center axis of the plug body 2. The contact springs 4*a* and 4*b* work to cause pressure against the inner wall of the cigar lighter socket in the event of removing/inserting the plug body 2 to/from the cigar lighter socket. More specifically, clamping forces are generated by the spring forces of the contact springs 4*a* and 4*b* between the plug body 2 and the socket, and the contact springs 4*a* and 4*b* are electrically conductive to the inner wall of the socket. The lead wire 12, which is one (second lead wire) of the two lead wires, is soldered and thereby connected to an end portion of the contact spring 4*b*, which is one of the contact springs.

As shown in FIG. 2, a slender fuse 5 having a substantially cylindrical shape and including contact terminals 5*a* and 5*b* at both ends is replaceably mounted in the plug body 2. In this event, the contact terminal 5*a* located at one end portion of the fuse 5 is abutted against the rear end of the contact pin 3, and then the fuse 5 is compressed towards the contact pin 3 by a compression spring 6 (described below) disposed on a side spaced apart from the contact pin 3.

A metallic fixed base 7 fixedly mounted to the plug body 2 is provided on the rear end side of the fuse 5 spaced apart from the contact pin 3 in the plug body 2. The fixed base 7 functions as a fixed electrode of the invention, and is soldered and thereby connected to the lead wire 11 (first lead wire), which is the other one of the two lead wires described above. The above-described compression spring 6 is disposed in the compressed state between the fixed base 7 and the contact terminal 5*b* provided to the rear end side of the fuse 5.

As such, when the plug 10 having the above-described construction is inserted into the cigar lighter socket (not shown), the contact springs 4*a* and 4*b* flex and thereby generate clamping forces for compressing the socket inner wall. Thereby, the contact pin 3, which is located at the lead end in the removal/insertion direction, is abutted against a bottom wall (not shown) of the socket and is then pushed in. In this state, the contact pin 3 is prevented by restoring forces of the contact springs 4*a* and 4*b* from falling out of the socket of the plug body 2. Concurrently, the contact pin 3 is compressed by restoring forces of the compression spring 6 onto the bottom wall of the socket, whereby electrical connection or coupling is secured.

Figure 3:
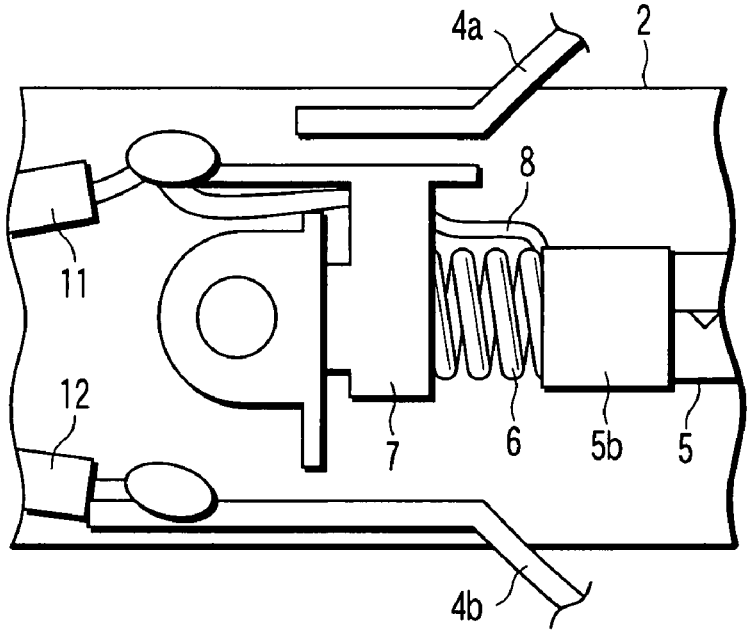
FIG. 3 is a partially enlarged view of major portions explaining a short-circuit structure according to a first embodiment of the invention.

FIG. 3 is a partially enlarged view of a connection structure between the fixed base 7 and the contact terminal 5*b* of the fuse 5.

In general, the fuse 5 is replaceable for the plug body 2, and simple compression contact is made between the compression spring 6 and the contact terminal 5*b* for compressing the fuse 5. It is known that since the compression spring 6 has a coil shape, the contact resistance between the compression spring 6 and the plain contact terminal 5*b* is relatively high, and heat is generated in that portion. In this manner, when the heat is generated at the site where the contact resistance is high, a worst case can take place in which the plug body 2 is melted by the heat. In this case, there is a probability of burning injury of a user.

For example, in the event that a 14-inch wide TV set is connected to the cigar lighter socket by using the conventional plug equipped cord, the power consumption is about 70 [W]. In this case, a connection portion between the compression spring and the contact terminal of the fuse is heated to a very high temperature. As such, the probability of the burning injury by the heat is very high.

In consideration of the above, in the present embodiment, a RITZ wire 8 for electrically short-circuiting the compression spring 6 is provided between the fixed base 7 and the contact terminal 5*b* of the fuse 5. The RITZ wire 8 functions as a conductive member of the invention and has a structure fabricated by interlacing a large number of slender metal wires. As shown in FIG. 3, in the present embodiment, one end of the RITZ wire 8 is connected to an end portion on the side that is in contact with the contact terminal 5*b* of the fuse 5 of the compression spring 6, and the other end thereof is fixed to a connection portion between the fixed base 7 and the lead wire 11.

As described above, the RITZ wire 8 has the structure fabricated by interlacing a large number of slender metal wires, such that the RITZ wire 8 is flexibly bendable, and is capable of following expansion/compression of the compression spring 6. More specifically, in the event of removal from or insertion into the socket of the plug 10, the RITZ wire 8 followingly deforms in the event of expansion/compression of the compression spring 6.

In addition, because of the structure fabricated by interlacing a large number of metal wires, the cross-sectional area of the RITZ wire 8 can be formed to be relatively large. Thus, the RITZ wire 8 is capable of reducing electrical resistance of its own, thereby making it possible to reduce current flowing through the compression spring 6. Consequently, the provision of the RITZ wire 8 makes it possible to significantly reduce the degree of heat generation between the compression spring 6 and the contact terminal 5*b*.

More specifically, the RITZ wire 8 of the present embodiment was practically connected to between the contact terminal 5*b* and the fixed base 7, and a current of 7 [A] was continually applied and flowed therethrough. As a consequence, the contact resistance between the contact terminal 5*b* of the fuse 5 and the compression spring 6 was reduced to about one fifth, thereby reducing the temperature of heat by about 20° C.

As described above, according to the present embodiment, only by the addition of the simple construction in which the RITZ wire 8 is wired between the contact terminal 5*b* of the fuse 5 and the fixed base 7, heat in the contact portion between the fuse 5 and the fixed base 7 can be significantly reduced, and safety of the plug in use can be improved.

Figure 4:
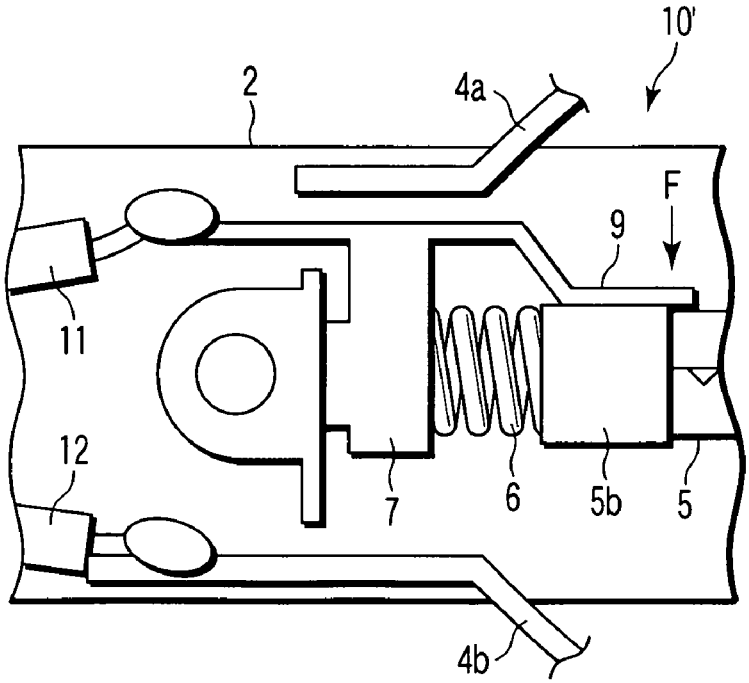
FIG. 4 is a partially enlarged view of major portions explaining a short-circuit structure according to a second embodiment of the invention.

FIG. 4 is a partially enlarged view of a major portion of a plug equipped cord (or, a plug) according to a second embodiment of the present invention. A construction shown in FIG. 4 is similar to the construction described in conjunction with FIG. 3. However, a plug 10' shown in FIG. 4 has a construction including, instead of the RITZ wire 8, a metal piece 9 extending from the fixed base 7. The other portions of the construction are identical to those of the plug 10 described above. As such, in the present case, only the different portion (that is, the metal piece 9) will be described in more detail below, and detailed descriptions of the other portions will be omitted herefrom.

The fixed base 7 of the plug 10' has the metal piece 9 integrally extending towards the contact terminal 5*b* of the fuse 5. The metal piece 9 functions as the conductive member of the invention, and has a leaf spring structure causing an extensional end portion thereof to be compressed against the contact terminal 5*b* of the fuse 5. In the present embodiment, the direction of compression by the metal piece 9 against the contact terminal 5*b* is the direction substantially perpendicular to the longitudinal direction of the fuse 5 (direction shown by the arrow F). Preferably, a surface portion of the contact terminal 5*b* with which the metal piece 9 is in contact is arcuate along a peripheral surface of the contact terminal 5*b*, thereby making it possible to reduce contact resistance therebetween.

By employing the construction described above, in the event of expansion/compression of the compression spring 6, the metal piece 9 slides along the peripheral surface of the contact terminal 5*b*, whereby the expansion and compression of the compression spring 6 are not disturbed. In addition, by the compression of the lead end of the metal piece 9 against the contact terminal 5*b*, contact therebetween can be stabilized. Further, since the leaf spring structure integral with the fixed base 7 is employed as the conductive member, the fuse 5 can easily be replaced, the number of components/parts can be reduced, and the manufacturing costs can be reduced. Consequently, compared to the RITZ wire 8 of the first embodiment described above, since the time and labor for soldering both ends of the RITZ wire 8 are not necessary, the number of steps can be reduced.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

For example, while the respective embodiments have been described with reference to the case where the RITZ wire 8 or the metal piece 9 is employed as the conductive member for short-circuiting the compression spring 6, no limitations are imposed thereto. The conductive member may be of any type as long as it has an electrical resistance lower than at least the compression spring 6 and is deformable following the expansion and compression of the compression spring 6.

What is claimed is:

1. A plug comprising:

a plug body;

a fuse provided in the plug body, the fuse including a first contact terminal;

a fixed electrode that is provided in the plug body, the fixed electrode being spaced apart from the first contact terminal;

a spring that is provided in a compressed state between the fixed electrode and the first contact terminal of the fuse; and a conductive member coupled to a top surface of the first contact terminal and altered in form based on movement of the spring, the conductive member to electrically short-circuit the spring in order to provide an alternative electrical path between the fuse and the fixed electrode.

2. The plug according to claim 1, wherein the fuse further comprises a second contact terminal positioned on an opposite side of the fuse from the first contact terminal.

3. The plug according to claim 1, further comprising a first contact in contact with the second contact terminal of the fuse and positioned at a lead end of the plug, the first contact being extendable and retractable.

4. The plug according to claim 3, further comprising a second contact extending externally from a peripheral surface of the plug body and coupled to a lead wire.

5. The plug according to claim 3, wherein the spring urges the fuse toward the first contact.

6. The plug according to claim 1, wherein the conductive member includes an interlaced wire fabricated by interlacing a plurality of slender metal wires.

7. The plug according to claim 6, wherein the interlaced wire electrically couples the first contact terminal of the fuse and a first lead wire.

8. The plug according to claim 1, wherein the conductive member includes a metal piece integrally extended from the fixed electrode to the first contact terminal of the fuse.

9. The plug according to claim 8, wherein the metal piece has a leaf spring structure that compresses a lead end spaced apart from the fixed electrode against the first contact terminal of the fuse.

10. The plug according to claim 9, wherein a compression direction of the metal piece is in a direction substantially perpendicular to a longitudinal direction of the fuse.

11. A plug equipped cord, comprising:

a plug body;

a first lead wire and a second lead wire that are extended from a rear end side of the plug body;

a first contact provided to a lead end of the plug body;

a fuse provided in the plug body, the fuse including a first contact terminal and a second contact terminal in contact with the first contact;

a fixed electrode provided in the plug body coupled to the first lead wire and electrically coupled to the first contact terminal;

a spring provided in a compressed state between the fixed electrode and the first contact terminal of the fuse, the spring being biased to move the fuse towards the first contact; and a conductive member coupled to the first contact terminal of the fuse and the fixed electrode, the conductive member to electrically short-circuit the spring to provide another electrical path between the first contact terminal and the fixed electrode.

12. The plug equipped cord according to claim 11, further comprising a second contact extended externally from a peripheral surface of the plug body and coupled to the second lead wire.

13. The plug equipped cord according to claim 11, wherein the conductive member includes an interlaced wire fabricated by interlacing a plurality of slender metal wires.

14. The plug equipped cord according to claim 13, wherein the interlaced wire electrically couples the first contact terminal of the fuse and the first lead wire.

15. The plug equipped cord according to claim 11, wherein the conductive member includes a metal piece integrally extended from the fixed electrode to the first contact terminal of the fuse.

16. The plug equipped cord according to claim 15, wherein the metal piece has a leaf spring structure that compresses a lead end spaced apart from the fixed electrode against the first contact terminal of the fuse.

17. The plug equipped cord according to claim 16, wherein a compression direction of the metal piece is a direction substantially perpendicular to a longitudinal direction of the fuse.

18. A plug comprising:

a plug body;

a fuse provided in the plug body, the fuse including a first contact terminal;

an electrode provided in the plug body, the electrode being spaced apart from the first contact terminal;

a spring interposed between the electrode and the first contact terminal of the fuse; and a conductive member coupled to a top surface of the first contact terminal and altered in form based on movement of the spring, the conductive member to electrically short-circuit the spring and provide an alternative electrical path between the fuse and the electrode.

19. The plug according to claim 18, further comprising a first contact positioned at a lead end of the plug and coupled to the second contact terminal of the fuse, the first contact being extendable and retractable.

20. The plug according to claim 18, wherein the conductive member includes a plurality of interlaced wires electrically coupling the first contact terminal of the fuse and a lead wire to supply power to an electrical appliance.

* * * * *